US006840140B1

(12) United States Patent
Wenacur

(10) Patent No.: US 6,840,140 B1
(45) Date of Patent: Jan. 11, 2005

(54) ADJUSTABLE MARINE AND AVIATION TOOL

(76) Inventor: Joel Wenacur, 8375 Horseshoe Bay Rd., Boynton Beach, FL (US) 33437

( * ) Notice: Subject to any disclaimer, the term of this patent is extended or adjusted under 35 U.S.C. 154(b) by 0 days.

(21) Appl. No.: 10/642,786

(22) Filed: Aug. 19, 2003

(51) Int. Cl.[7] ..... B25B 13/10
(52) U.S. Cl. ..... 81/176.3; 81/461; 81/125; 81/442; 81/451
(58) Field of Search ..... 81/125, 176.1, 81/176.15, 442, 451, 461, 176.3

(56) References Cited

U.S. PATENT DOCUMENTS

| | | | | |
|---|---|---|---|---|
| 1,263,202 | A | 4/1918 | Brown | |
| 1,384,705 | A | 7/1921 | Meyer | |
| 2,542,728 | A * | 2/1951 | Thoms | 81/176.3 |
| 2,803,981 | A | 8/1957 | Stoecker | |
| 3,007,357 | A | 11/1961 | Nalley | |
| 3,048,067 | A | 8/1962 | Miles et al. | |
| 3,186,263 | A | 6/1965 | Grote | |
| 3,259,000 | A | 7/1966 | Lasch, Sr. | |
| 4,059,033 | A | 11/1977 | Johnson | |
| 4,148,234 | A | 4/1979 | Steimle | |
| 4,210,327 | A | 7/1980 | Schubert | |
| 4,336,729 | A | 6/1982 | Eppenbach | |
| 4,433,863 | A | 2/1984 | Mathews | |
| 4,883,588 | A | 11/1989 | Primavera et al. | |
| 5,011,150 | A | 4/1991 | Averill | |
| 5,170,681 | A | 12/1992 | Kemp | |
| 5,213,016 | A | 5/1993 | Kah, Jr. | |
| 6,095,017 | A | 8/2000 | Long | |
| 6,116,120 | A | 9/2000 | Boe | |
| 6,701,810 | B2 * | 3/2004 | Adamczyk et al. | 81/176.3 |
| 2002/0139225 | A1 | 10/2002 | Carter | |
| 2003/0029280 | A1 | 2/2003 | Adamczyk et al. | |

* cited by examiner

*Primary Examiner*—James G. Smith
(74) *Attorney, Agent, or Firm*—McHale & Slavin, P.A.

(57) ABSTRACT

A marine or aviation tool for moving and replacing a marine or aviation cover having a pair of spaced holes as a pair of pins which are adjustable to be aligned with the holes. The pins extend from head having socket therein for receiving either extender which cooperates with ratchet wrench handle or another extender which cooperates with a screw gun drill so that one has the option of rotating the head directly as a key or operating the head remotely. The head includes a VELCRO® patch for coupling with a mating VELCRO® patch on the cover so that after the cover is removed it remains attached to the head will not fall overboard due to broken chain.

8 Claims, 8 Drawing Sheets

ADJUSTABLE MARINE AND AVIATION TOOL

FIELD OF THE INVENTION

The present invention is directed to an adjustable marine and aviation tool. More particularly, the present invention is directed to an adjustable marine and aviation tool having projecting pins for engagement with spaced holes in marine covers.

BACKGROUND OF THE INVENTION

Generally, removable covers are used for dosing ports through decks of boats that connect with tanks within the boat hulls such as fuel tanks and water tanks. Such covers are also used with aircraft. Fuel tanks of boats and planes present special hazards since diesel fuel is flammable, and gasoline and jet fuel are both flammable and explosive. If a boat is being fueled with gasoline, there is always a danger of a spark occurring in or adjacent to the tank that can initiate an explosion. Accordingly, it is advisable that covers for these ports be removed and replaced carefully with minimal slippage of tools which could result in a spark if a tool strikes a metal object. Frequently, tools for opening covers are misplaced and screwdrivers are used which can slip out of a groove that usually extends between the two holes normally adapted to receive pins projecting from a key.

Normally, covers are attached to a fuel port with a ball chain which is anchored within the port. These chains break rather frequently so that after a cover has been removed, it is no longer secured and can fall overboard. Since there is usually no spare cover aboard, a boater might simply replace the cover with a rag which unfortunately may serve as a wick, thus lifting gasoline vapors out of the fuel tank. These vapors can accumulate in the hull outside of the fuel tank and present an explosion hazard.

In many instances, covers for fuel or water ports are not conveniently accessible in boats, requiring the person opening the port to extend their arms into recessed areas. Moreover, ports are frequently, located in a deck, which requires the person opening the port to kneel or stoop in order to reach the port with a key. Kneeling and stooping can be uncomfortable and on occasion results in injury. Consequently, there is a need to have a marine tool which makes it easier to remove and replace covers. The same general concerns are an issue for the fuel ports of aircraft.

SUMMARY OF THE INVENTION

In view of the aforementioned considerations, the present invention relates to a marine or aviation tool for rotating externally threaded marine or aviation covers which close ports through decks or other portions of boat hulls and through fuselage or wings of aircraft, wherein the covers include holes laterally spaced from one another for receiving spaced pins on the tool. According to the present invention, the tools comprise a head having a first surface adapted to face the cover when the tool is engaged and a second surface facing away from the cover and displaced from the first surface to provide a selected thickness for the head. A slot extends transversely through the head and opens through the first surface. A first pin is fixed to the head and extends from the first surface of the body for seating in one hole and a second pin is mounted on a slider within the slot in the head for lateral adjustment with respect to the first pin. In order to rotate the head so as to remove or replace the cover using a ratchet wrench, a square socket extends through the second surface of the head. The socket is adapted to receive a square stud projecting either from an extender rod for a ratchet wrench handle or from the ratchet wrench handle itself. Patches of hook and loop material are fixed to first face of the head and are adapted to engage a complementary patch of loop or hook material fixed to the cover, so that when pins of the tool are in the holes in the cover, the head of the tool is axially coupled with the cover.

In a further aspect of the invention, the stop for the slider is a set screw threaded through the head into contact with the slider.

In still a further aspect of the invention, the slider has a lateral groove therein aligned with the set screw for receiving the set screw.

In another aspect of the invention the head has a convex second surface and flat sides extending transverse to the first surface for facilitating direct gripping of the tool by a person's hand.

In still another aspect of the invention, the hook and loop fasteners are disposed between the pins on the head and between the holes in the cover and have a thickness less than the lengths of the pins so that the pins must be aligned with and enter the holes before the hook and loop fasteners are coupled.

In still a further aspect of the invention, the tool is configured as a kit containing the head with the projecting pins; an extender for use with a ratchet wrench handle, and an extender for use with screw gun drill.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
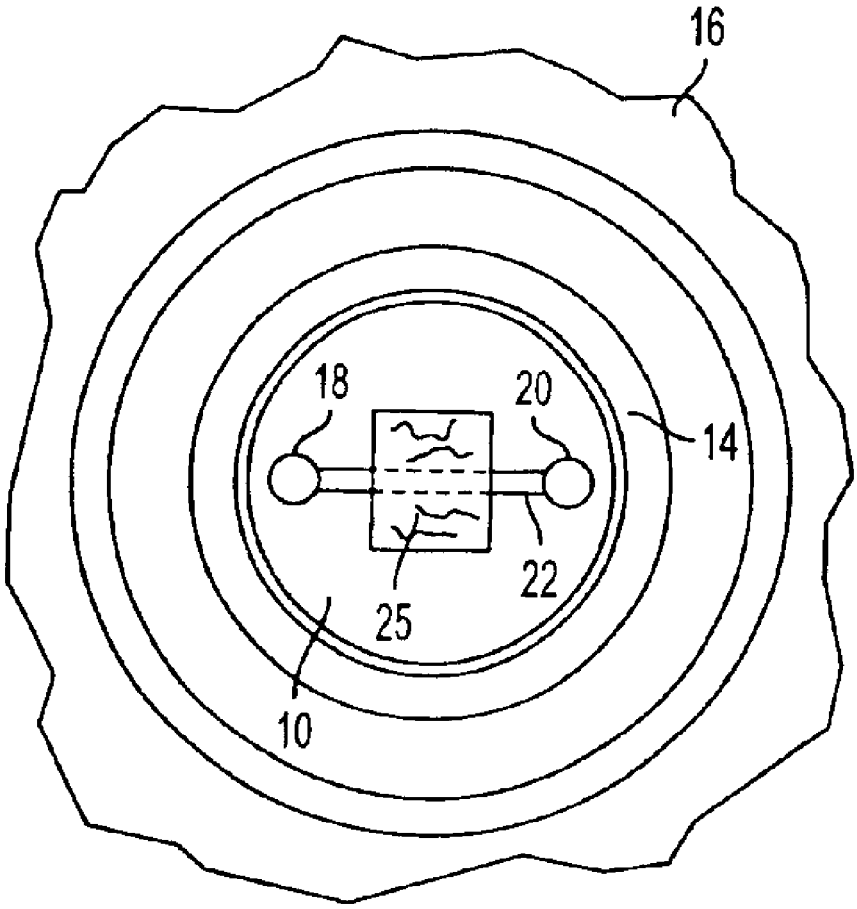
FIG. 1 is a top view of a cover used to close a fuel, water or waste port through a deck or other portions of a boat or aircraft.

Referring now to FIG. 1 there is shown a marine or aviation cover which is openable and closable by rotation about an axis 12. The marine or aviation cover 10 closes a port 14 in a deck 15 or other structure of a boat, or in a wing or fuselage of an aircraft, and is used to fill tanks within the boat with water or fuel or tanks within an aircraft with fuel. The marine cover 10 is externally threaded and is screwed into internal threads in the port 14. In order to facilitate rotation of the cover 10, the cover has a first cylindrical hole 18 and a second cylindrical hole 20, that is spaced a selected distance from the first cylindrical hole. In accordance with most configurations for marine covers, the cover 10 has a slot 22 extending between the cylindrical holes 18 and 20 for receiving a coin or screw driver to open the cover if a key for that purpose for some reason is not available. In accordance with the present invention, the cover 10 has a VELCRO® patch 25 adhered thereto with either hooks or loops projecting a selected distance upwardly therefrom.

Figure 2:
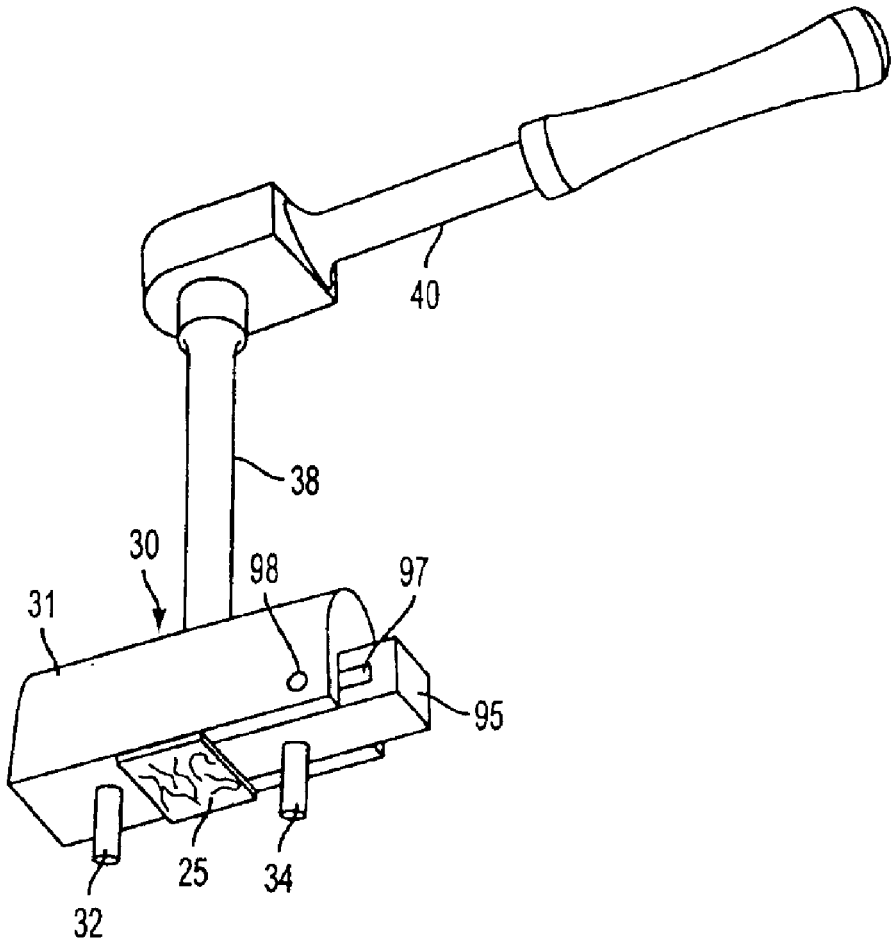
FIG. 2 is a perspective view of a marine or aviation tool used to open and reclose the cover of FIG. 1.
Figure 5:
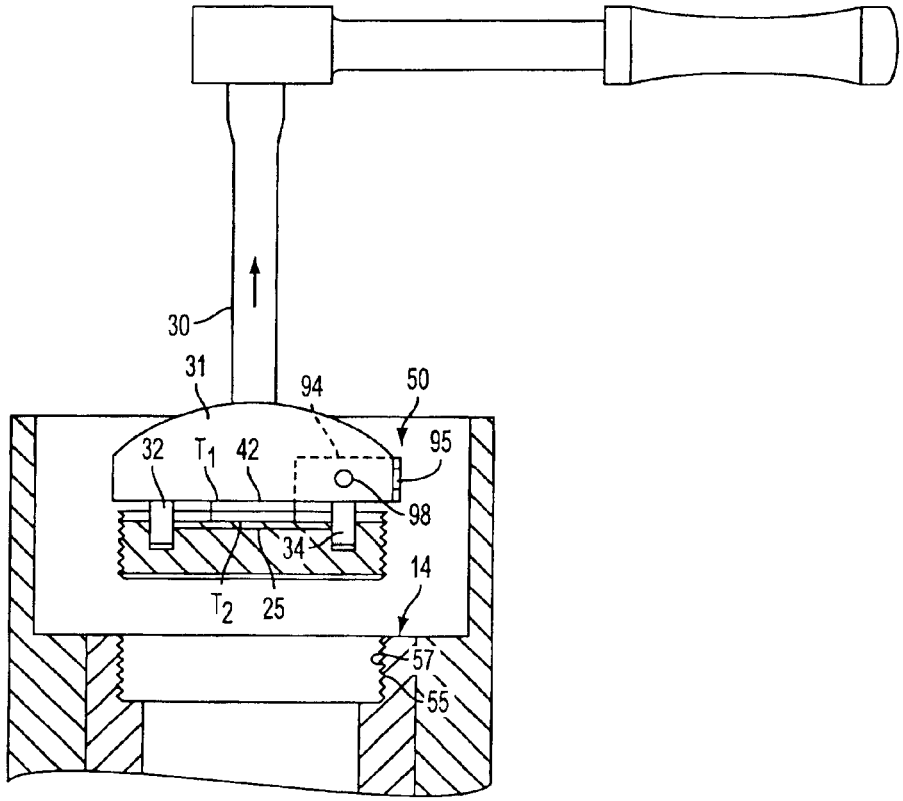
FIG. 5 shows the tool lifting the cover away from the port after opening the port.
Figure 6:
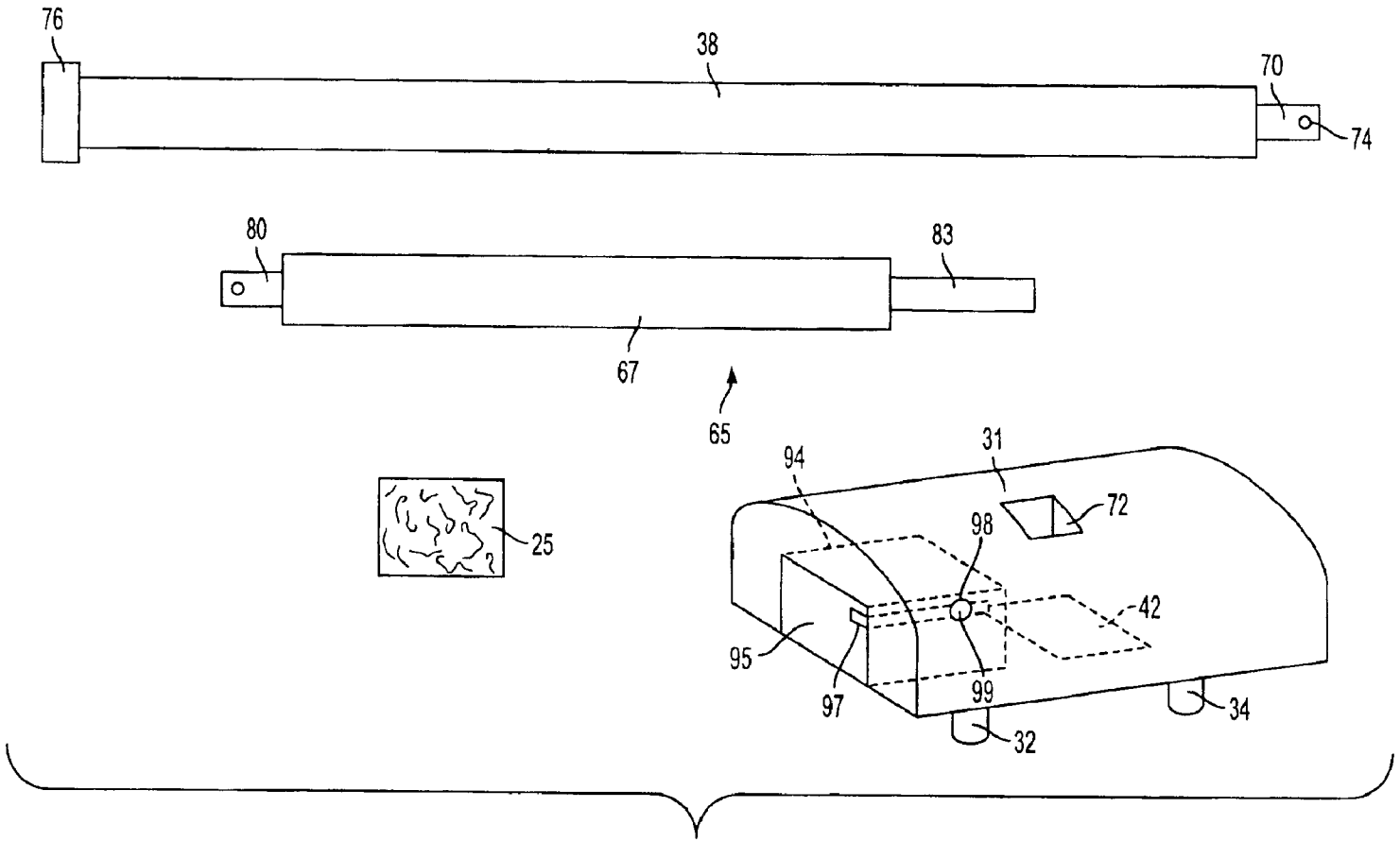
FIG. 6 is an exploded view, partially in perspective, showing components for a marine or aviation tool kit of the present invention.

Referring now to FIG. 2 there is shown a marine or aviation tool 30 configured in accordance with the principles of the present invention and assembly from components of a kit shown in FIG. 6. Marine or aviation tool 10 includes a head 31 having a pair of projecting pins 32 and 34 that are received in the holes 18 and 20 in cover 10. The head 32 has extender 38 detachably coupled thereto, which extender is coupled to the projecting stud of a ratchet wrench handle 40. A second extender 67 for use with screw gun drill (see FIG. 5) may also be used. Between the pins 32 and 34 is a VELCRO® patch 42. Optionally, the head 31 may be used without either extender and may be directly gripped by hand.

Figure 3:
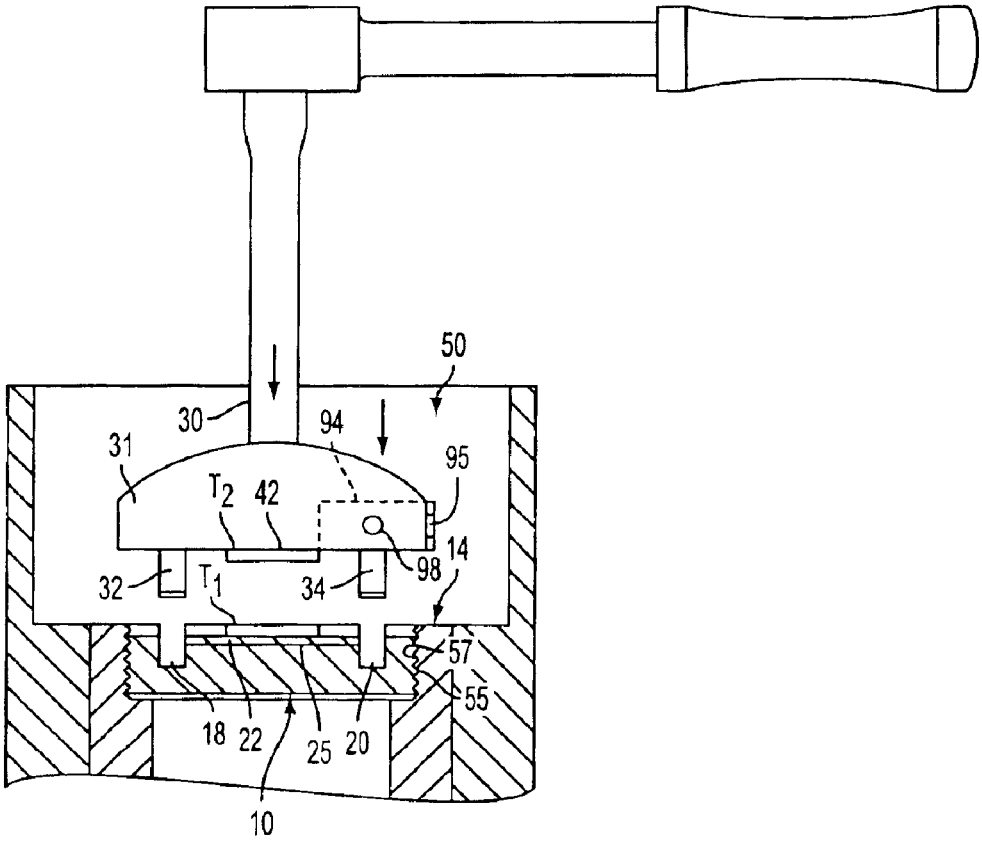
FIG. 3 is a side elevation showing the tool of FIG. 2 just prior to coupling with the cover of FIG. 1.
Figure 4:
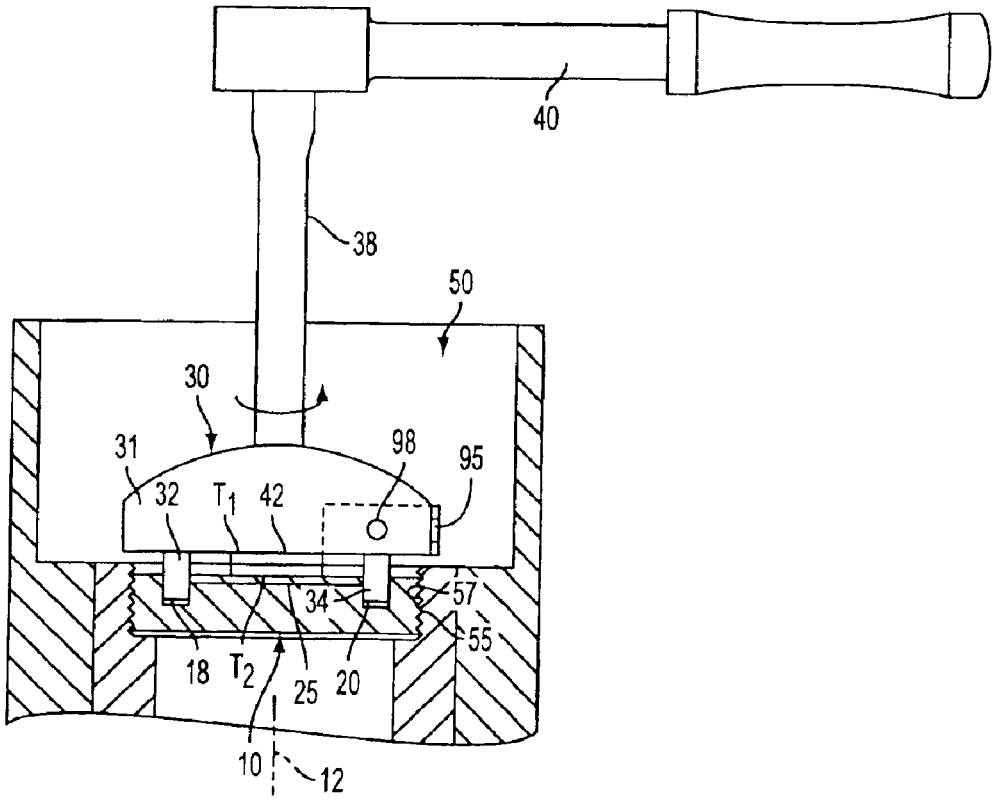
FIG. 4 is a side elevation similar to FIG. 3, but showing the marine or aviation tool coupled with the cap of FIG. 1.

Referring now to FIGS. 3–5, it is seen that the cover 10 is positioned with in a restricted space 50 that makes removing and replacing the cover 10 inconvenient. As is evident in FIG. 3, when the head 31 of the marine or aviation tool 30 is not positioned so that the pins 32 and 34 are not aligned with the holes 18 and 20, the VELCRO® patch 42 is spaced from the VELCRO® patch 25 so there is no gripping of the cover 10 by the tool 30 in the direction of axis 12. This is because the VELCRO® patches can not engage. The VELCRO® patches 25 and 42 have thicknesses $t_1$ and $t_2$ respectively, which have a combined thickness less than the lengths of the pins 32 and 34. Consequently, unless the pins 32 and 34 are received in the holes 18 and 20, the tool 30 can not grip the cover 10 in the axial direction.

As is seen in FIG. 4, upon advancing the tool 30 axially so that the pins 32 and 34 advance into the holes 18 and 20, the hooks and loops of the VELCRO® patches 25 and 22 engage. As the tool 30 is torqued in the counter clockwise direction, the cover 10 rotates about its axis 12 and the external threads 55 on the cover 10 advance over the internal threads 57 of the port 14 causing the cover to unscrew from the port. The cover 10 is then lifted away from the port 14 while still attached to the head 31 by the VELCRO® patches 25 and 42 (see FIG. 5).

The cover 10 remains attached to the head 31 while port 14 is being filled with water or fuel. When it is time to close the port 14, the cover 10 is realigned with the port 14 and rotated in the clockwise direction so as to be threaded back down into the port. A slight rocking of the head 31 while pulling in the direction of the axis 12 releases VELCRO®°patch 42 from the VELCRO® patch 25 allowing the pins 32 and 34 to slide completely out of the holes 18 and 20.

While in FIGS. 3–5 the cover 10 is shown within a restricted space 50, the same principles apply if the cover is used with a port thought a deck 15 which does not have a restricted space around the port.

Referring now to FIG. 6 where a complete kit 65 for the tool 30 is shown, it is seen that the kit 65 is comprised of the head 31, the twenty-four inch extender 38 which cooperates with ratchet wrench handle 40 of FIG. 2; the VELCRO® patch 25, and a twelve-inch extender 67 for use with a screw gun drill. To utilize the kit, the VELCRO® patch 25 is adhered to the cover 10 as seen in FIG. 1. The customer makes a decision as to whether the head 31 is to be used without either the twenty-four inch extender 38 or the twelve-inch extender 67. If the twenty-four inch extender 38 is used, a stud 70 on the lower end of the extender 38 is inserted into a square socket 72 and is retained by a ball detent 74 in a manner similar to the way in which a ratchet wrench handle 40 (FIG. 2) engages and holds a socket for rotating nuts. At the second end of the twenty four-inch extender 38 a female coupling 76 is provided which receives the male lug extending from a ratchet wrench handle 40 (see FIG. 2).

It is desired when necessary to tighten the cover 10 using a screw gun drill (not shown), the twelve-inch extender 67 is used. The twelve-inch extender 67 has a male lug 80 and ball detent 81 that is receivable in the square socket 72 and a male lug 83 at the opposite end which is received in the chuck of the screw gun drill (not shown).

The twenty-four inch extender 38 allows a person to rotate the cover 10 while standing, thus avoiding the discomfort and possible injury stemming from kneeling or squatting in order to remove or replace the cover 10. The twelve-inch extender 67 also is useful in awkward situations in which it is difficult to use the head 31 by itself as a key.

Figure 7:
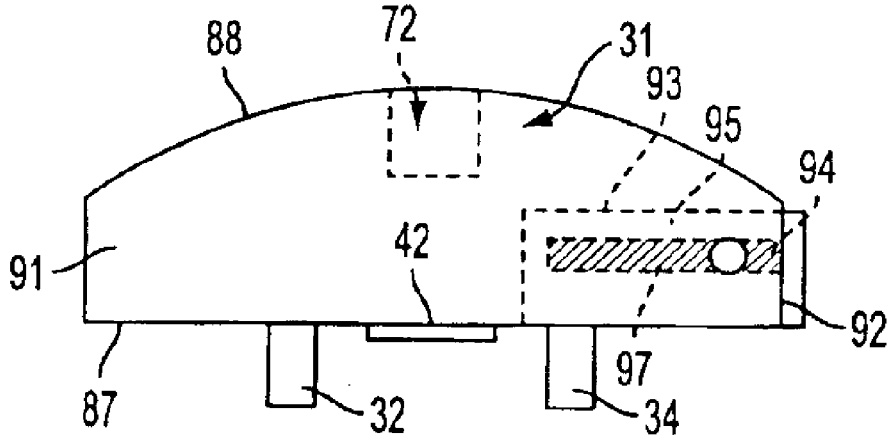
FIG. 7 is side perspective view of a tool head as shown in FIGS. 2–6 and configured in accordance with the principles of the present invention.
Figure 8:
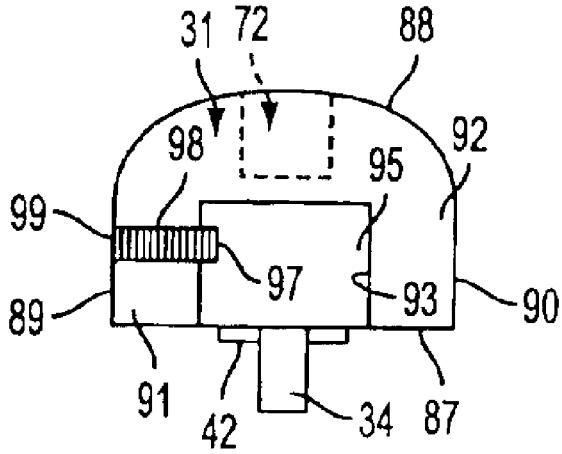
FIG. 8 is a side view of the tool head of FIG. 7 taken along lines 7—7 of FIG. 7.

Referring now to FIGS. 7 and 8 where the details of the head 31 are shown in elevation, it is seen that head is a distinct unit having a flat bottom surface 87 which faces the cover 10 and a convex top surface 88 which faces away from the cover and joins the flat bottom surface 87 with side surfaces 89 and 90 and end surfaces 91 and 92. The slider 95 has a flat bottom surface 96 which is flush with the flat bottom surface 87 of the head 31.

The second pin 34 is mounted on a slider 95 which is received in channel 93 opening through the flat bottom surface 87 and the end surface 92 of the head 31. The slider 95 has a groove 97 therein which receives a set screw 98 having an allen wrench opening 99. Since the channel 93 is rectangular or square in cross section and the slider 95 is also rectangular or square, engagement of the set screw 98 in the groove 97 keeps the slider 95 from falling out the channel 93.

The distance between the pins 32 and 34 is adjustable by backing out the screw 97 and sliding the pin 34 outward or inward in order align both pins with the holes 18 and 20 in cover 10. When properly aligned with the holes 18 and 20, the set screw 98 is tightened against the bottom of the groove 97 so that the distance between the pins 32 and 34 remains fixed. The marine or aviation tool 30, configured either the head 31 alone, or with the extenders 38 or 67, is then ready for use.

Figure 9:
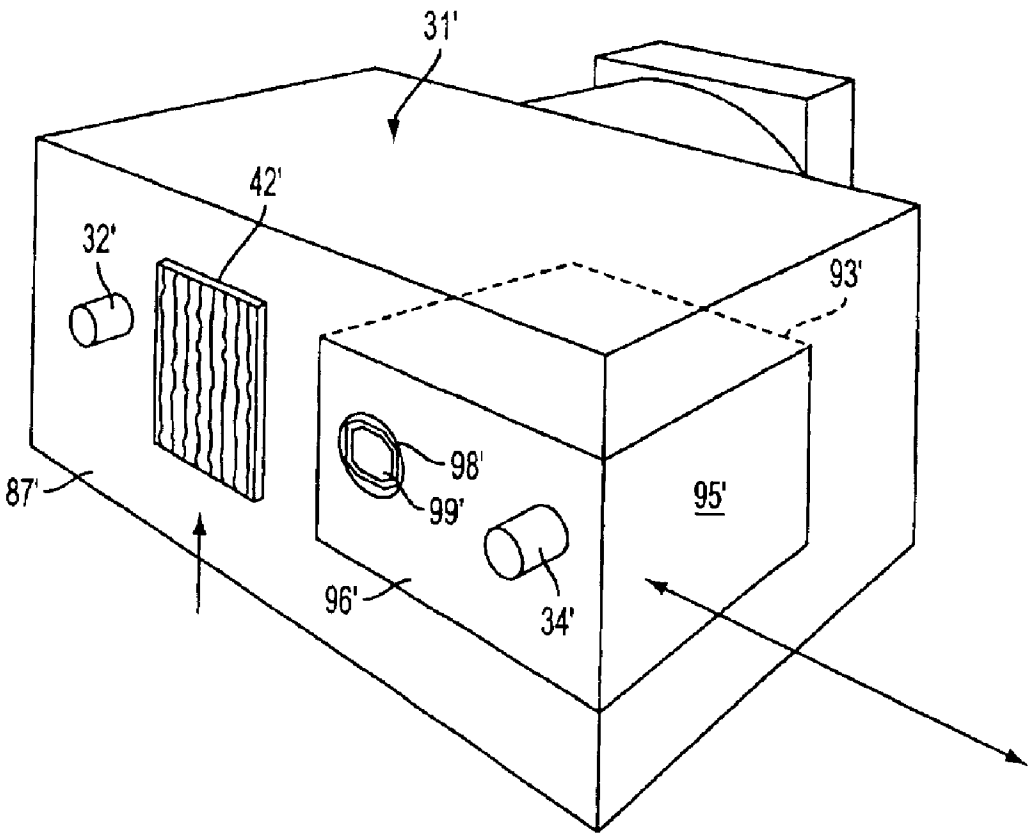
FIG. 9 is a perspective view of another embodiment of the invention.

Referring now to FIG. 9, in an alternative embodiment the slider 95' has a set screw 98' similar to set screw 98, having an alien wrench socket 99' through the bottom surface 96' of the slider 95. The set screw 98' passes completely through the slider 95' and bares against the top surface 100 of the slot 93' to keep the slider 95' in a selected position of adjustment. In the arrangement of FIG. 9, the set screw 98' is between the two pins 32' and 34'.

The head 31 of the tool 10 is made of steel, stainless steel, brass, aluminum or a polymer material, such as polyamide which may be filled with glass fibers, or another polymer material of a strength sufficient to make a tool.

From the foregoing description, one skilled in the art can easily ascertain the essential characteristics of this invention, and without departing form the spirit and scope thereof, can make various changes and modifications of the invention to adapt it to various usages and conditions.

I claim:

1. A marine and aviation tool for rotating externally threaded marine and aviation covers which close ports through decks or other portions of boats, or fuselages or wings and aircraft, wherein the covers include holes laterally spaced from one another for receiving spaced pins on the tool, the tool comprising:

a head having a first surface adapted to face the cover when the tool is engaged, a second surface facing away from the cover and displaced from the first surface to provide a selected thickness for the body, and a slot extending transversely through the body;

a first pin fixed to the head and extending from the first surface for seating in one hole, a second pin for seating in the other hole and mounted on a slider received in the slot for lateral adjustment with respect to the first pin;

a stop for engaging the slider to fix the second pin with respect to the first pin;

a square socket extending through the second surface and into the head, the socket adapted to receive a square stud projecting from an extender from a ratchet wrench handle or screw gun drill, and a patch of hook or loop material fixed to the first face of the head and adapted to engage a complementary patch of loop or hook material fixed to the cover, whereby the head is used to rotate the threaded cover with the extender or without the extender when the tool is coupled with the cover axially with the latching patches and is coupled with the cover radially when the pins are in the holes.

2. The tool of claim 1 wherein the stop for the slider is a set screw threaded through the head into contact with the slider.

3. The tool of claim 2 wherein the slider has a lateral groove therein aligned with the set screw for receiving the set screw.

4. The tool of claim 3 wherein the head has a convex second surface and flat sides extending transverse to the first surface for facilitating a hand grip of the tool.

5. The tool of claim 4 wherein the socket is disposed at a lateral location between the pins.

6. The tool of claim 4 wherein the head is made of steel, stainless steel, brass, polymer or aluminum.

7. The tool of claim 1 wherein the patches each have a predetermined thickness and the pins each have a predetermined length which are greater than the thicknesses of the patches, wherein the hooks of one patch do not engage the loops of the other patch until the pins are aligned with and pushed into the holes.

8. The tool of claim 1 wherein the tool is configured as a kit comprising the head; the hook or loop patch for applications to the cover; an extender for use with a ratchet wrench handle, and an extender for use with a screw gun drill.

* * * * *